US009553388B2

(12) United States Patent
Endo et al.

(10) Patent No.: US 9,553,388 B2
(45) Date of Patent: Jan. 24, 2017

(54) ELECTRICAL CONNECTOR

(71) Applicant: Dai-ichi Seiko Co., Ltd., Kyoto-shi, Kyoto (JP)

(72) Inventors: Takayoshi Endo, Shizuoka (JP); Kenya Ando, Shizuoka (JP)

(73) Assignee: Dai-ichi Seiko Co., Ltd., Kyoto-shi, Kyoto (JP)

( * ) Notice: Subject to any disclaimer, the term of this patent is extended or adjusted under 35 U.S.C. 154(b) by 0 days.

(21) Appl. No.: 15/139,180

(22) Filed: Apr. 26, 2016

(65) Prior Publication Data

US 2016/0322735 A1 Nov. 3, 2016

(30) Foreign Application Priority Data

Apr. 28, 2015 (JP) ..... 2015-092004

(51) Int. Cl.
*H01R 13/436* (2006.01)
*H01R 13/52* (2006.01)

(52) U.S. Cl.
CPC ..... *H01R 13/4364* (2013.01); *H01R 13/52* (2013.01)

(58) Field of Classification Search
CPC ..... H01R 13/4362; H01R 13/4364; H01R 13/4365
USPC ..... 439/752, 733.1
See application file for complete search history.

(56) References Cited

U.S. PATENT DOCUMENTS 5,100,346 A * 3/1992 McCardell ..... H01R 13/111 439/595
6,283,799 B1 * 9/2001 Fukase ..... H01R 13/4365 439/752
6,305,990 B1 * 10/2001 Ward ..... H01R 13/432 439/752
7,179,135 B2 * 2/2007 Osada ..... H01R 13/4365 439/752
7,179,136 B1 * 2/2007 Morello ..... H01R 13/4223 439/140
2004/0038589 A1 * 2/2004 Takahashi ..... H01R 13/4365 439/595
2010/0105254 A1 * 4/2010 Park ..... H01R 13/40 439/752

(Continued)

FOREIGN PATENT DOCUMENTS

JP S6264076 3/1987
JP 2000208195 A 7/2000

(Continued)

*Primary Examiner* — Tulsidas C Patel
*Assistant Examiner* — Marcus Harcum
(74) *Attorney, Agent, or Firm* — Howard & Howard Attorneys PLLC

(57) ABSTRACT

An electrical connector includes a connector terminal, a housing formed with a slider groove, and a retainer locking the connector terminal and preventing the connector terminal from being released by sliding from the unlocking position to the locking position. The retainer includes a basal end housed in the slider groove, and a projection projecting from the basal end toward the opening of an engagement hole. The basal end is formed with an operation hole in which an operating jig that changes the position of the retainer between the locking position and the unlocking position is inserted. The projection is formed with a guide portion that guides the insertion of the operating jig in the operation hole.

9 Claims, 19 Drawing Sheets

(56) References Cited

U.S. PATENT DOCUMENTS

2013/0023163 A1* 1/2013 Glick ..... H01R 13/426
439/752

FOREIGN PATENT DOCUMENTS

JP 2001043925 2/2001
JP 2009110701 5/2009

* cited by examiner

ELECTRICAL CONNECTOR

CROSS-REFERENCE TO RELATED APPLICATION

This application claims the benefit of Japanese Patent Application No. 2015-092004, filed on Apr. 28, 2015, the entire disclosure of which is incorporated by reference herein.

FIELD

This application relates generally to an electrical connector that includes a retainer which prevents connector terminals from coming loose.

BACKGROUND

Connector terminals are housed in the terminal housing rooms formed in a housing. The connector terminals are prevented from coming loose by lances which are formed in the terminals housing rooms and which lock the connector terminals. However, downsizing of electrical connector is now advancing, and there is a tendency that the holding force for the connector terminals by the lances alone may become inadequate. Hence, the housing is provided with a retainer, and the connector terminals are doubly locked, thereby enhancing the holding force for the connector terminals.

The electrical connectors that doubly lock the connector terminals are disclosed in, for example, Unexamined Japanese Patent Application Kokai Publication No. S62-64076 (Patent Literature 1), Unexamined Japanese Patent Application Kokai Publication No. 2001-43925 (Patent Literature 2), and Unexamined Japanese Patent Application Kokai Publication No. 2000-208195 (Patent Literature 3).

The electrical connector disclosed in Patent Literature 1, as illustrated in FIG. 23 of the present application, have a stopper lever member 3*b* and a locking lever member 8*b*. The stopper lever member 3*b* is engaged with the connection terminal 2*b* provided in the housing 1*b*. The locking lever member 8*b* extends from the backward side of the housing 1*b* toward the forward side thereof, and has the front end that is a free end 9*b*. A user pushes a pushing end 11*b* to spread the locking lever members 8*b* outwardly. Thereby, the free end 9*b* of the locking lever member 8*b* is engaged with a locking pawl 7*b* of the connection terminal 2*b*.

The electrical connector disclosed in Patent Literature 2, as illustrated in FIGS. 24-25 of the present application, includes a mail terminal holder 103A, a female terminal holder 105A, and a female terminal locking 104A. The female terminal locking 104A is slidable in X-direction and X' direction.

As shown in FIG. 25 of the present application, the flexible stopper piece 1012 of the female terminal 102A is locked with the engagement tier 1040*c*. Further, when the user slides the female terminal locking 104A, the vertical wall 1033 of the female terminal locking 104A and the vertical portion 1031*a* of the frame 31 are engaged with the shoulder portion 1019 of the female terminal 102A, and thus the female terminal 102A is locked.

The electrical connector disclosed in Patent Literature 3, as illustrated in FIG. 26 of the present application, has a side retainer 1130. The side retainer 1130 is slideable between the tentative locking position and the final locking position where the male terminal fitting 111 is engageable.

The slide of the side retainer 1130 is performed by inserting a jig in the operating portion 1135 formed in the side retainer 1130.

According to the electrical connector disclosed in Patent Literature 1, however, when downsizing of the electrical connector advances, the engagement hole of the housing is also downsized. Hence, the fitting work between the locking lever members 8*b* with the pushing member 10*b* being held becomes difficult. In addition, when the connection terminal 2*b* is pulled hard in the pull-out direction, depending on the warpage condition of the locking lever member 8*b*, the locking of the connection terminal 2*b* may be released.

In addition, according to the electrical connector disclosed in Patent Literature 2, likewise, when downsizing of the electrical connector advances, the operation lever 1036 becomes tiny, making the user difficult to slide the female terminal locking 104A while holding the operation lever 1036.

Still further, according to the electrical connector disclosed in Patent Literature 3, when the jig is inserted in the retainer, a contact portion of the male terminal fitting 111 and the internal face of the engagement recess 1112 of the outer housing 1110 may be damaged.

SUMMARY

Hence, an objective of the present disclosure is to provide an electrical connector which is operable without any damages to the connector terminal and a housing when a retainer is operated even if downsizing advances.

An electrical connector according to an aspect of the present disclosure includes:

a connector terminal;

a housing comprising a terminal housing room in which the connector terminal is to be fitted, an engagement hole in which an engagement counterpart electrical connector is to be fitted, and a slider groove that is formed in a backmost wall of the engagement hole so as to extend in a direction intersecting with a fitting and releasing direction of the connector terminal; and a retainer which comprises a protrusion that locks the connector terminal fitted in the terminal housing room, and which changes a position between an unlock position where the protrusion unlocks the connector terminal, and a locking position which is reachable by sliding from the unlock position along the slider groove, and where the protrusion locks the connector terminal, wherein:

the retainer further comprises a basal end portion to be housed in the slider groove, and a projection projecting from the basal end toward an opening of the engagement hole;

the basal end is formed with an operation hole in which a operating jig is inserted, the operating jig changing the position of the retainer between the unlocking position and the locking position; and the projection is formed with a guide portion that guides an insertion of the operating jig into the operation hole.

It is desirable that the guide portion is formed with, from an insertion opening in which the operating jig is inserted to the operation hole of the basal end, a cut-out section along an insertion direction of the operating jig.

It is desirable that the guide portion has both ends in a sliding direction of the basal end or an orthogonal direction to the sliding direction formed asymmetrically to restrict the insertion of the operating jig in the operation hole in an inappropriate posture.

It is desirable that the basal end comprises a recess, or a convex portion engaged with a convex portion or a recess of the housing when the retainer is located at the unlocking position and the locking position, respectively.

It is desirable that the position of a tip of the projection is consistent with a position of a tip of the connector terminal in a projecting direction toward the engagement hole or projects from the position of the tip of the connector terminal.

It is desirable that a position of a tip of the projection is consistent with a position of a tip of the connector terminal in a projecting direction toward the engagement hole or projects from the position of the tip of the connector terminal.

It is desirable that, when, with the operating jig being in an appropriate posture, the operating jig is inserted in the operation hole of the retainer, and the retainer is in the unlocking position and/or the locking position, the operating jig abuts an internal wall of the engagement hole of the housing.

It is desirable that, with the operating jig being in an inappropriate posture, when the retainer is in the unlocking position or the locking position, the operating jig interferes with an aperture edge of the engagement hole, and the insertion of the operating jig in the guide portion is prevented; and with the operating jig being in the inappropriate posture, when the operating jig is inserted in the guide portion and the retainer is in the locking position or the unlocking position, the operating jig abuts the internal wall of the engagement hole, and a sliding of the operating jig is restricted.

It is desirable that, with the operating jig being in an inappropriate posture, the operating jig interferes with the guide portion of the retainer and can be not inserted into the guide portion.

BRIEF DESCRIPTION OF THE DRAWINGS

A more complete understanding of this application can be obtained when the following detailed description is considered in conjunction with the following drawings, in which.

DETAILED DESCRIPTION

First Embodiment

An electrical connector according to a first embodiment of the present disclosure will be explained with reference to the accompanying FIGS. 1 to 18. In the following explanation, the expression "back and forth" is a reference expression with a fitting side to an engagement counterpart electrical connector being as "forward side" and the opposite side thereto being as "backward side".

Figure 1:
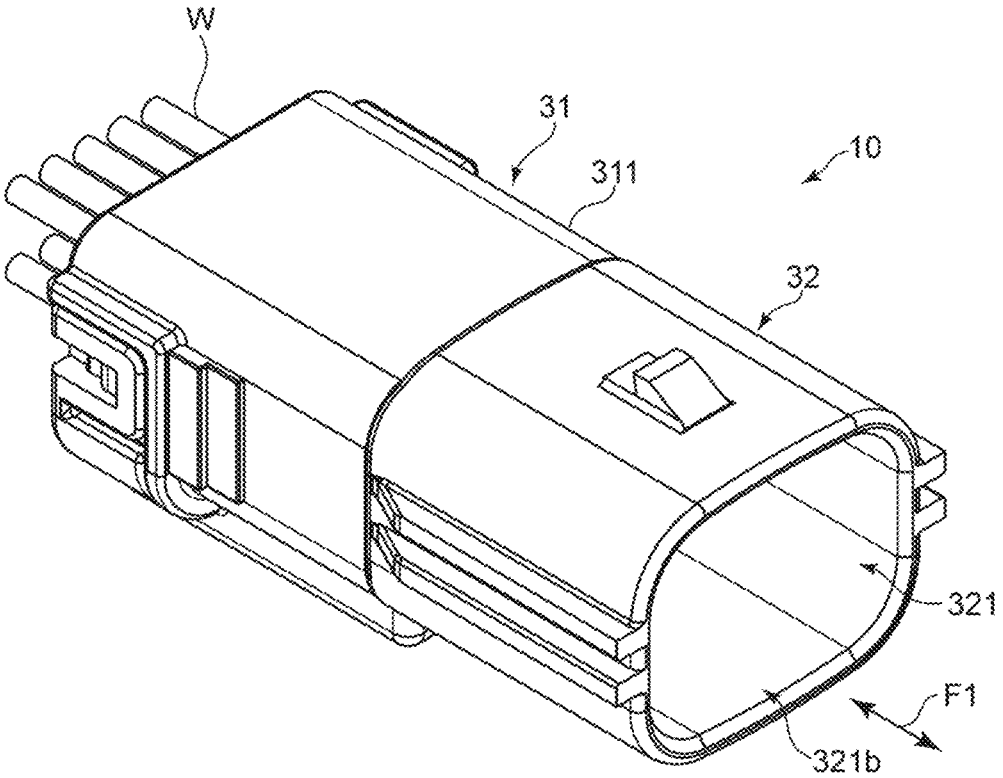
FIG. 1 is a perspective view illustrating an electrical connector according to a first embodiment of the present disclosure.
Figure 2A:
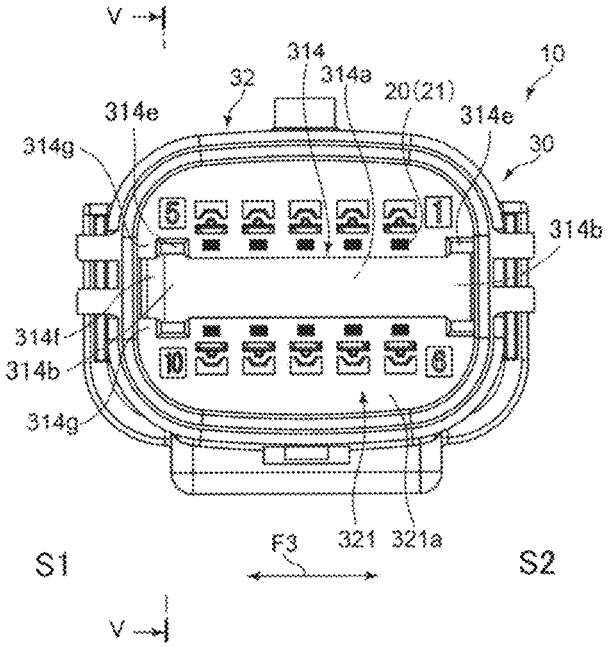
FIG. 2A is a view when the housing shown in FIG. 1 is viewed from an engagement hole side.
Figure 2B:
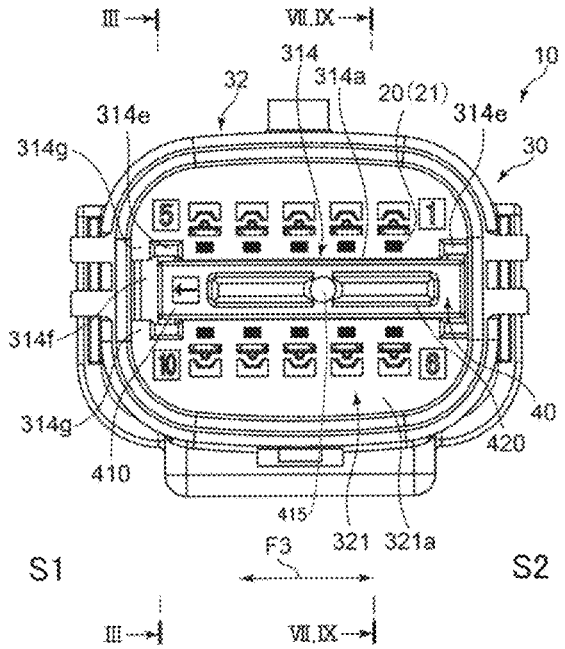
FIG. 2B is a view when the electrical connector in FIG. 1 is viewed from an engagement hole side.

An electrical connector 10 illustrated in FIGS. 1, 2A and 2B is a water-proof electrical connector. The electrical connector 10 includes a connector terminal 20, a housing 30, and a retainer 40.

Figure 7:
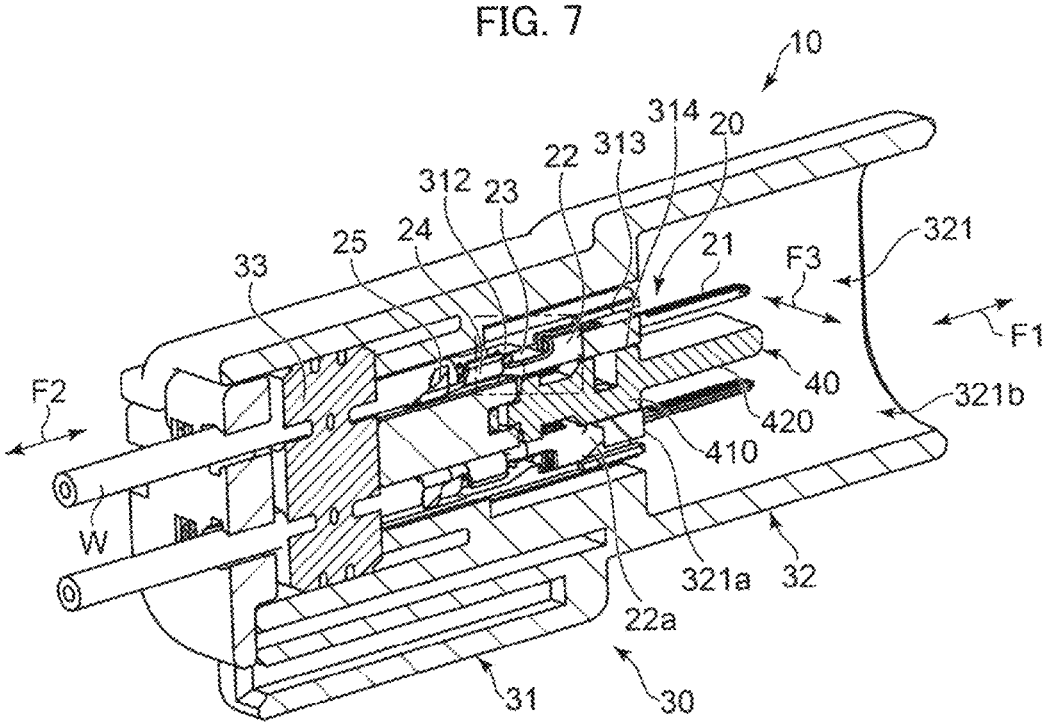
FIG. 7 is a VII-VII cross-sectional perspective view of the electrical connector in FIG. 2B when the retainer is at an unlocking position.
Figure 8:
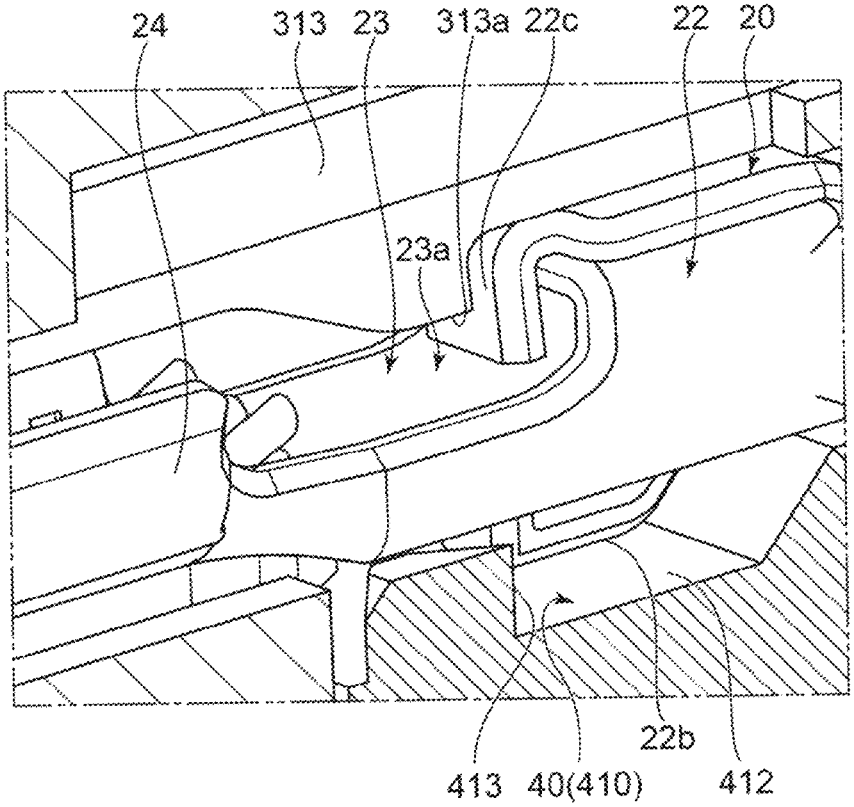
FIG. 8 is a partial enlarged view of the electrical connector illustrated in FIG. 7.
Figure 9:
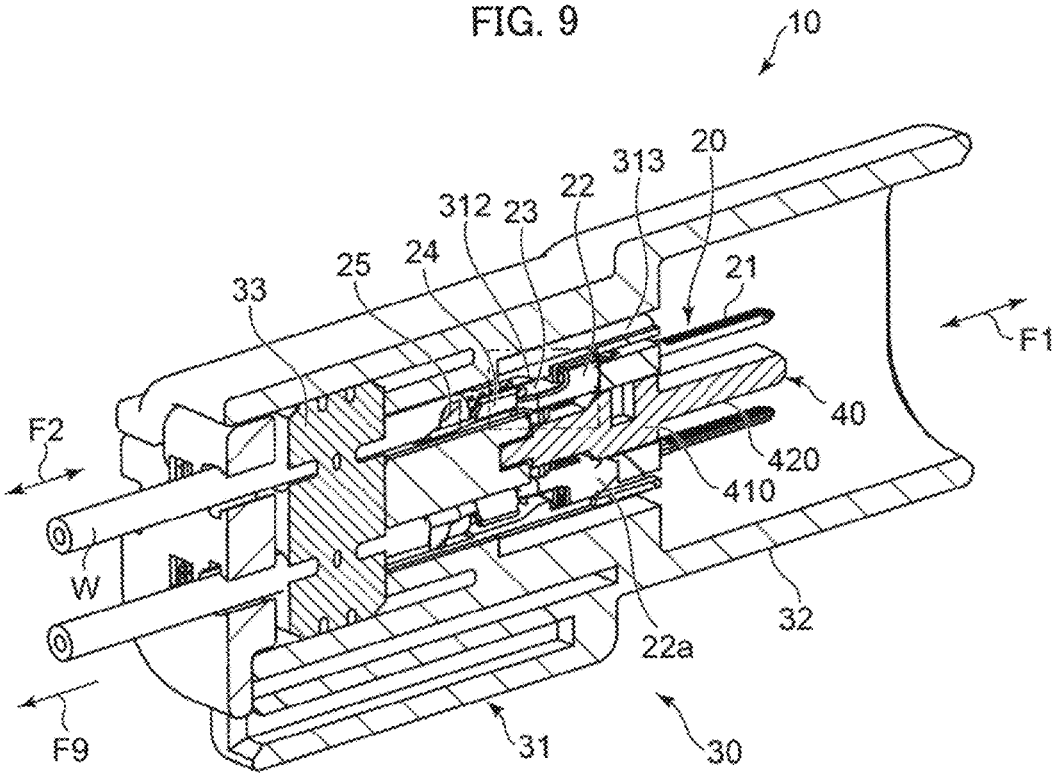
FIG. 9 is a IX-IX cross-sectional perspective view of the electrical connector in FIG. 2B when the retainer is at a locking position.
Figure 10:
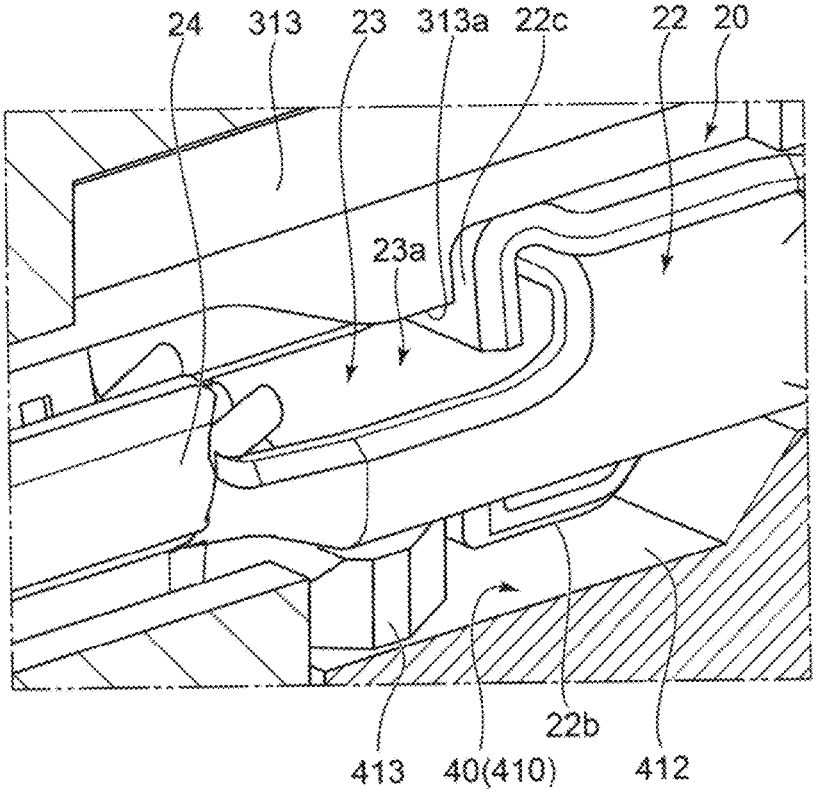
FIG. 10 is a partial enlarged view of the electrical connector illustrated in FIG. 9.

As illustrated in FIGS. 7-10, the connector terminal 20 is a male terminal. The connector terminal 20 includes a tab portion 21, a cylinder portion 22, a tier portion 23, a wire barrel portion 24, and an insulation barrel portion 25. Here, FIGS. 7 and 9 are cross sectional views of the same cross section in FIG. 2B. In FIG. 7, the retainer 40 is at an unlocking position for unlocking connector terminals 20, and in FIG. 9 the retainer 40 is at a locking position for locking the connector terminals 20. FIG. 8 is an enlarged view of the area denoted by dotted line in FIG. 7 and FIG. 10 is an enlarged view of the area denoted by dotted line in FIG. 9.

The tab portion 21 has a tip formed in a sharp needle shape, is fitted in and contacts the female connector terminal of a counterpart electrical connector. The cylinder portion 22 is formed in a rectangular cylindrical shape like a wound plate by multiple turns. The cylinder portion 22 is formed with a tapered portion 22*a* that becomes narrower toward the tab portion 21. The peripheral face of the cylinder portion 22 facing the retainer 40 is formed with a convex portion 22*b* to be locked by the retainer 40. Provided at the rear end of the cylinder portion 22 is a lance catch 22*c* that is a plate member forming the cylinder portion 22 bent downwardly toward an opening 23*a* of the tier portion 23. The tier portion 23 is formed in a shape that has a half portion in the orthogonal direction to the axial line of the cylinder portion 22 eliminated, thereby forming a tier relative to the cylinder portion 22.

The wire barrel portion 24 is to crimp and fasten a wire core revealed by eliminating the external cover skin of a wiring W in an electrically conducted connection condition. The wire barrel portion 24 is formed by folding protruding pieces protruding at both side relative to the axial line of the connector terminal 20 toward the wire core.

The insulation barrel portion 25 is to crimp and fasten the external cover skin that covers the wire core. The insulation barrel portion 25 is formed by folding protruding pieces at both sides relative to the axial line of the connector terminal 20 toward the wire core.

The housing 30 illustrated in FIGS. 1, 2A is a molded component formed of an insulation resin. The housing 30 includes a main body 31 where the connector terminals 20 are to be disposed, and a peripheral wall 32 that has a peripheral face 311 of the main body 31 so as to encircle an engagement hole 321 where the engagement counterpart electrical connector is to be fitted, and to extend in an engagement direction F1.

As illustrated in FIGS. 7-10, the main body 31 is formed with terminal housing rooms 312 in which the connector terminals 20 are to be fitted from the rear end side of the housing 30. The five terminal housing rooms 312 laid out in sequence are taken as a set, and two sets are laid out at both sides across the retainer 40, thereby corresponding to the layout of the connector terminals 20. A gasket 33 that water-tightly covers the wiring W connected to the connector terminal 20 is disposed at the rear side of the terminal housing room 312 of the main body 31.

A flexible piece 313 that extends from the position of the wire barrel portion 24 which is the rear portion of the connector terminal 20 toward the engagement hole 321 is formed in the terminal housing room 312. A lance 313*a* that protrudes toward the lance catch 22*c* of the connector terminal 20 is formed on the flexible piece 313.

Figure 5:
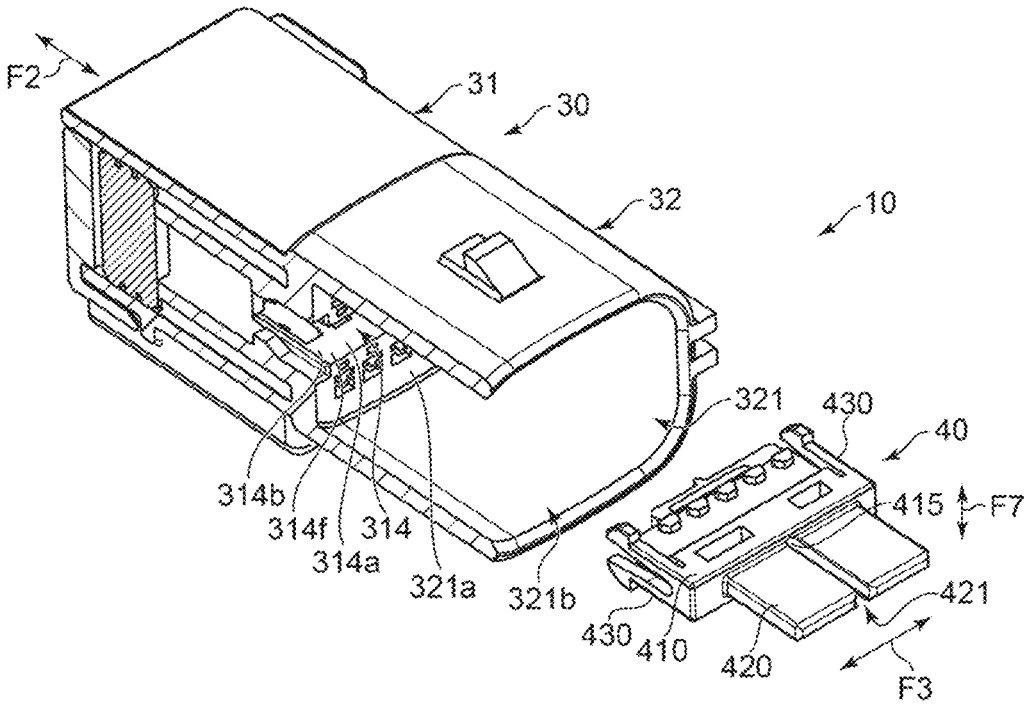
FIG. 5 is a V-V cross-sectional perspective view of the housing illustrated in FIG. 2A and a perspective view of the retainer.

As illustrated in FIG. 2A and FIG. 5 which is a V-V cross-sectional perspective view of FIG. 2A, a slider groove 314 that extends in the intersecting direction with the fitting and releasing direction F2 of the connector 20 is formed in a backmost wall 321*a* of the engagement hole 321 of the housing 30.

The slider groove 314 includes a basal-end-portion groove 314*a* where the basal end of the retainer 40 to be explained later is housed and slides, and attachment portion grooves 314*b* located at both ends of the retainer 40 in a sliding direction F3, thus being formed in an H shape as viewed from the engagement hole 321 side.

Figure 14:
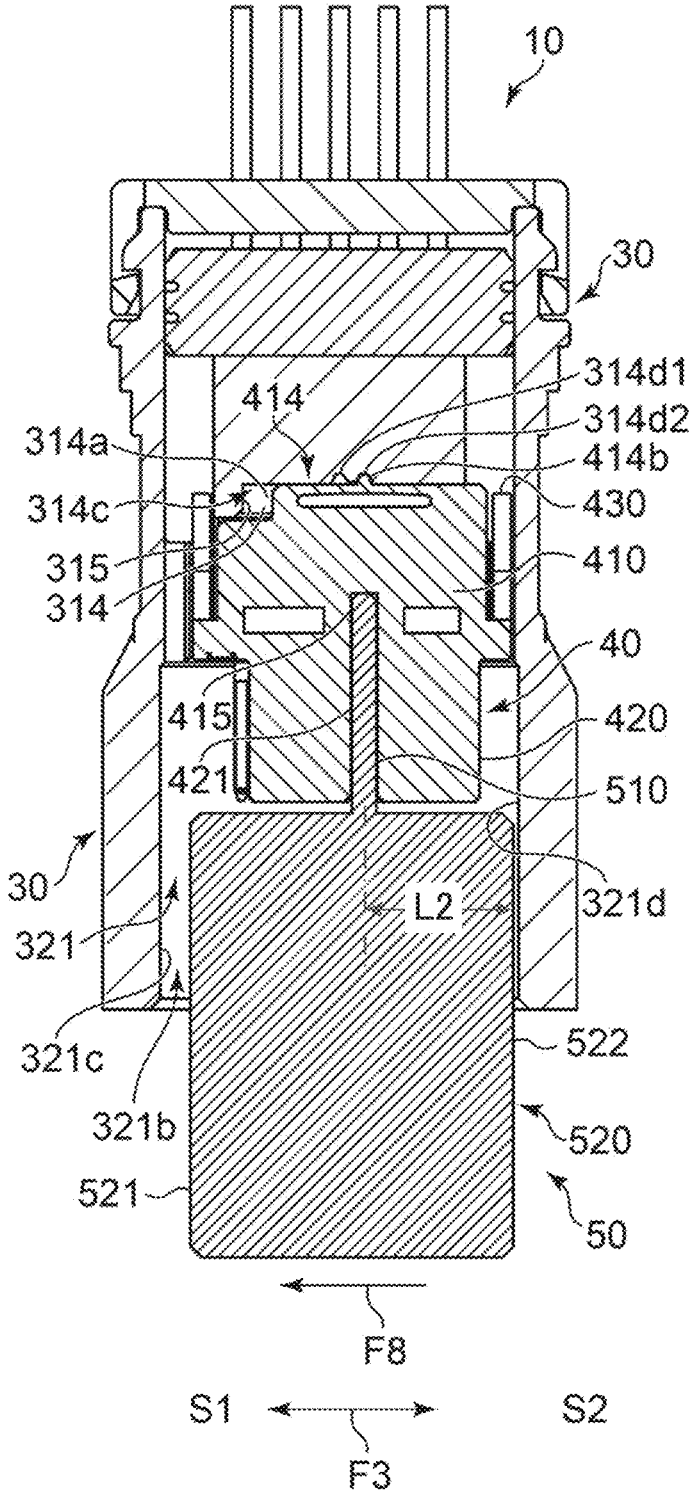
FIG. 14 is a horizontal cross-sectional view when the retainer of the electrical connector illustrated in FIG. 13 is at the unlocking position, and the operating jig is inserted.
Figure 15:
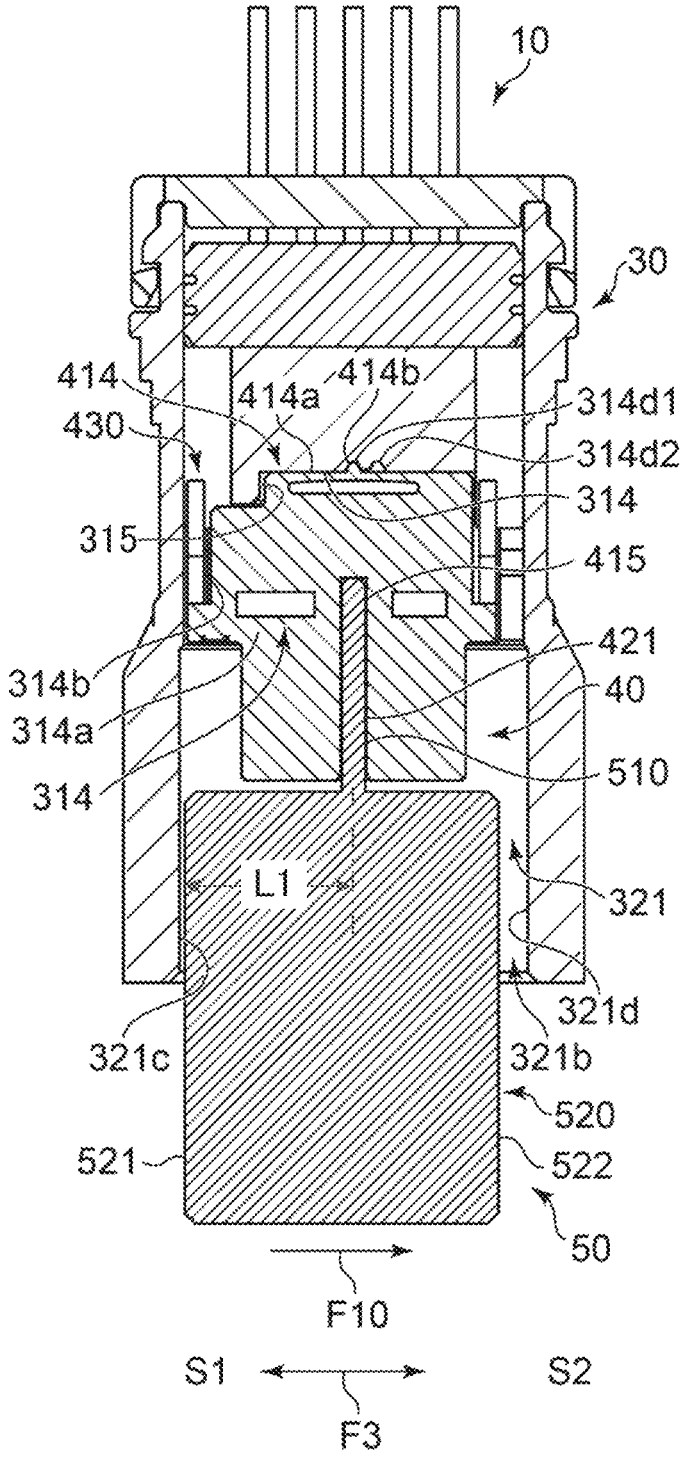
FIG. 15 is a horizontal cross-sectional view when the retainer of the electrical connector illustrated in FIG. 13 is at the locking position, and the operating jig is inserted.

As illustrated in FIGS. 14, 15, a groove bottom wall 314*c* of the basal-end-portion groove 314*a* that abuts the retainer 40 fitted in the slider groove 314 is formed with a protruding wall 315 at a side S1 in the sliding direction F3. The protruding wall 315 is to position the fitting position of the retainer 40 and the locking position when the retainer 40 is slid. In addition, the groove bottom wall 314*c* is also formed with a pair of recesses 314*d*1, 314*d*2 to be engaged with the convex portion of the retainer 40 to be explained later when the retainer 40 is at the locking portion or at an unlocking position.

Figure 3:
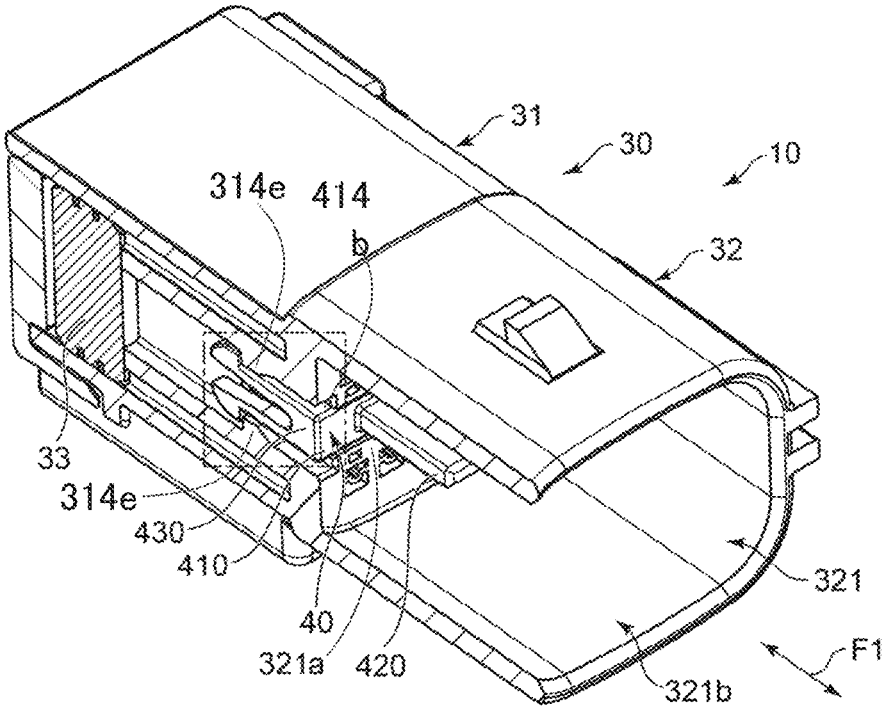
FIG. 3 is a cross-sectional perspective view of the electrical connector illustrated in FIG. 2B.
Figure 4:
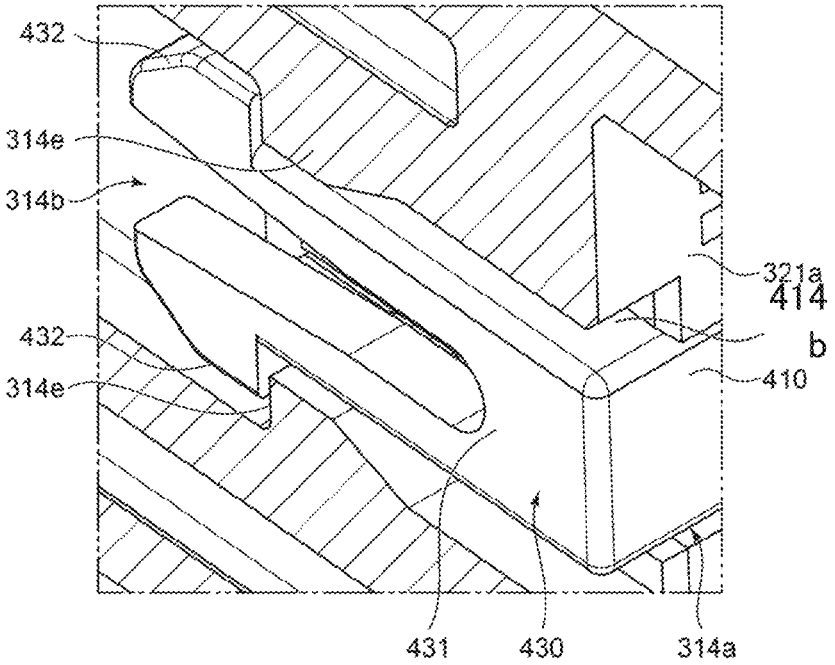
FIG. 4 is a partial enlarged view of the electrical connector illustrated in FIG. 3.

As shown in FIG. 2A, the attachment portion groove 314*b* is formed so as to have a wider groove with than that of the basal-end-portion groove 314*a*. In addition, the length of the attachment portion groove 314*b* in the sliding direction F3 covers a sliding width that allows the retainer 40 to slide between the locking position and the unlocking position. As illustrated in FIGS. 2A, 3, and 4 which is an enlarged view of dotted area in FIG. 3, respective groove faces of the attachment portion groove 314*b* facing with each other are formed with a pair of attachment protrusions 314*e* that narrow down the groove width.

As illustrated in FIG. 2A, the attachment portion groove 314*b* located at the one side S1 in the sliding direction F3 is formed with a closing portion 314*g* that closes a part of the opening 314*f* of the attachment portion groove 314*b* so as to narrow down the attachment portion groove 314*b*. Since the closing portion 314*g* restricts the fitting position of the attachment portion of the retainer 40 to be explained later, the retainer 40 fitted in the slider groove 314 is initially positioned at the unlocking position.

Figure 6:
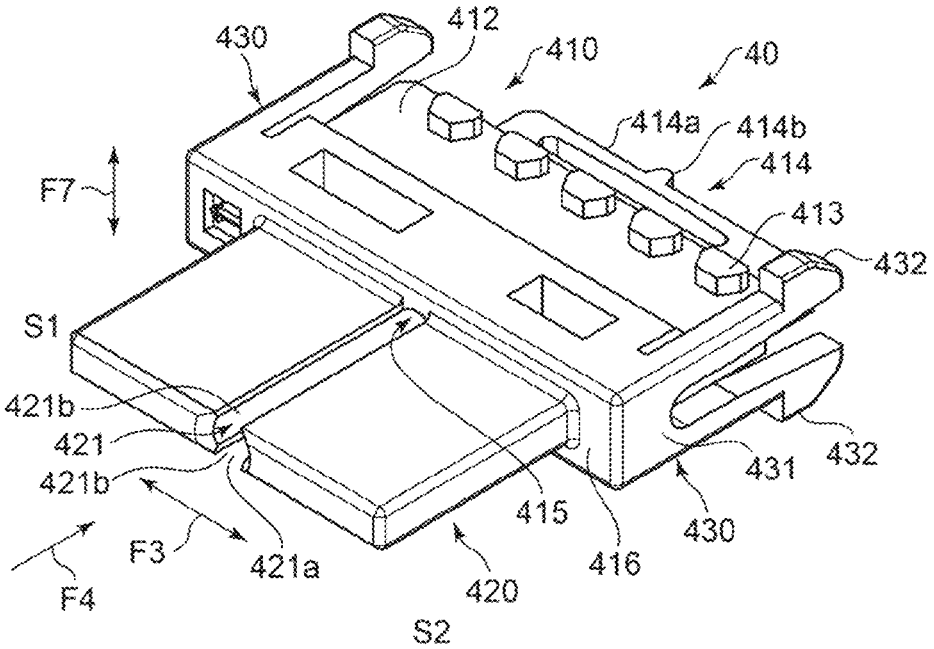
FIG. 6 is a perspective view of the retainer for the electrical connector illustrated in FIG. 5.

As illustrated in FIGS. 5, 6, the retainer 40 is attached to the slider groove 314 formed in the backmost wall 321*a* of the engagement hole 321. The retainer 40 includes a basal end 410 to be housed in the slider groove 314 and located at the backward side from the position of the backmost wall 321*a*, and projections 420 formed so as to protrude from the basal end 410 toward the opening 321*b* of the engagement hole 321. In addition, the retainer 40 includes an attachment portion 430 to attach the retainer 40 to the housing 30.

The rear portion of the basal end 410 is formed with a thinner portion 412 that is thinner than the front portion so as to form a tier. The thinner portion 412 is formed with protrusions 413 that lock the corresponding connector terminals 20 along the sliding direction F3, respectively. The protrusions 413 are formed on both of upper and lower surfaces of the thinner portion 412. As shown in FIGS. 7, 9, each of the protrusions 413 faces the convex portions 22*b* of the corresponding connector terminal 20 when the retainer 40 is at a locking position but not face any of the convex portions 22*b* when the retainer 40 is at the unlocking position.

The rear end face of the basal end 410 is formed with an engagement convexity 414. The engagement convexity 414 includes a cross-linking portion 414*a* which has a flexible portion between both ends with the both ends being fastened, and a convex portion 414*b* which protrudes backwardly from the cross-linking portion 414*a*.

The basal end 410 is formed with an operation hole 415 where an operating jig 50 to be explained later is inserted in order to change position of the retainer 40 between the unlocking position and the locking position. The operation hole 415 is formed at the position whose distance from one inner sidewall of the engagement hole 321 at one side S1 is L1 when the retainer 40 is at the locking position as shown in FIG. 15 and whose distance from the opposite inner sidewall of the engagement hole 321 at the other side S2 is L2 when the retainer 40 is at the unlocking position as shown in FIG. 14.

The projections 420 are formed in a plate shape. The projections 420 are provided at a location on a connection plane 416 with the basal end 410 offset toward the other side S2 in the sliding direction F3 with the projections 420 being attached to the housing 30. The projections 420 include a guide portion 421 which guides the insertion of the operating jig 50 to the operation hole 415 and which is formed at the center position in the sliding direction F3. The guide portion 421 is formed with a cut-out section 421*b* that runs from an insertion opening 421*a* into which the operating jig 50 is inserted to the operation hole 415 in the basal end 410 along an insertion direction F4 of the operating jig 50.

The cut-out section 421*b* divides the projections 420 into a portion at the one side S1 and a portion at the other side S2 in the sliding direction F3. The insertion opening 421*a* is formed so as to spread the open area toward the leading end side of the projection 420.

Figure 18:
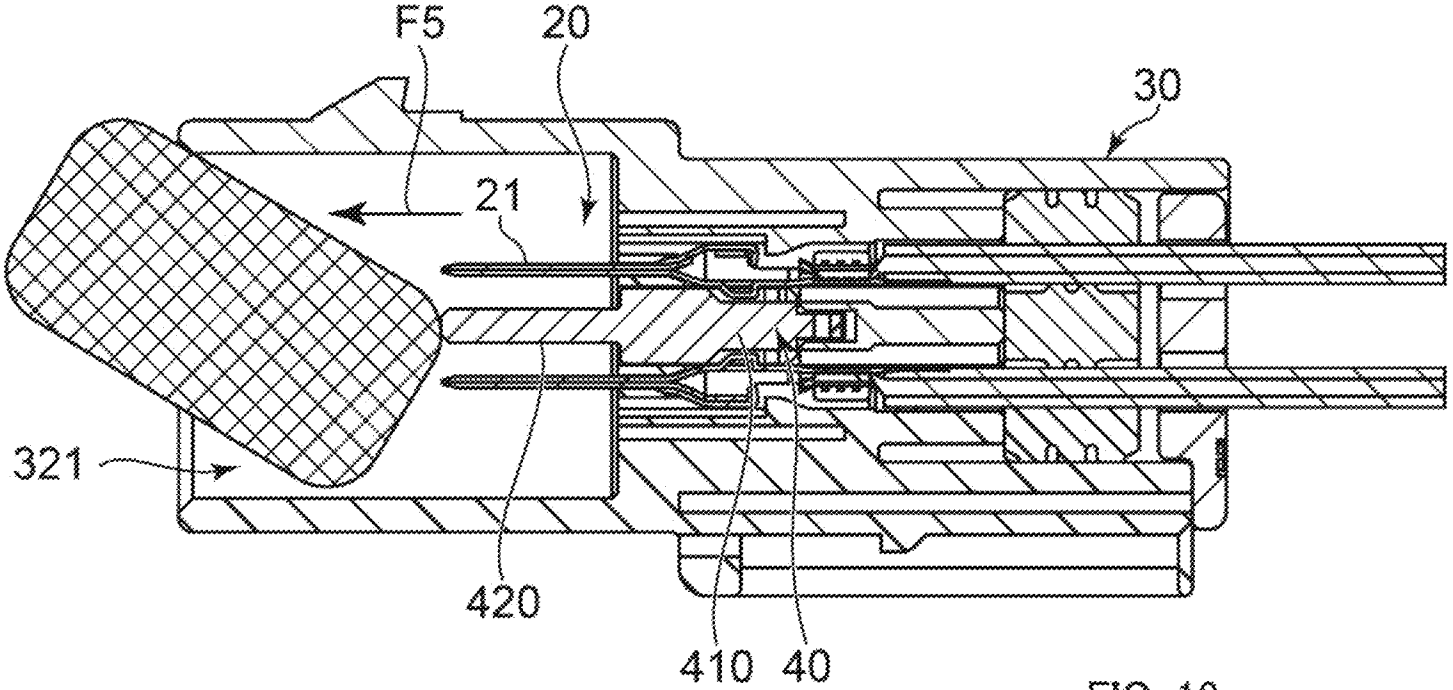
FIG. 18 is a vertical cross-sectional view for explaining a condition in which a foreign material enters in the electrical connector illustrated in FIG. 1.

As illustrated in FIG. 2B, the projections 420 have a contour dimension as viewed from the opening 321*b* of the engagement hole 321*b* which is smaller than that of the basal end 410 in both the sliding direction F3 and the orthogonal direction thereto. As illustrated in FIG. 18, tops of the projections 420 are formed so as to be located at the same position as that of the tips of the connector terminals 20 in a projecting direction F5 toward the engagement hole 321.

As illustrated in FIGS. 4, 6, the attachment portions 430 are formed at both ends of the basal end 410 in the widthwise direction (the same direction as the sliding direction F3). Each of the attachment portions 430 includes V-shaped arms 431 that spread the gap therebetween toward the tip from the base end, and pawls 432 formed at respective tips of the arms 431 and directed in opposite directions thereto.

Figure 11:
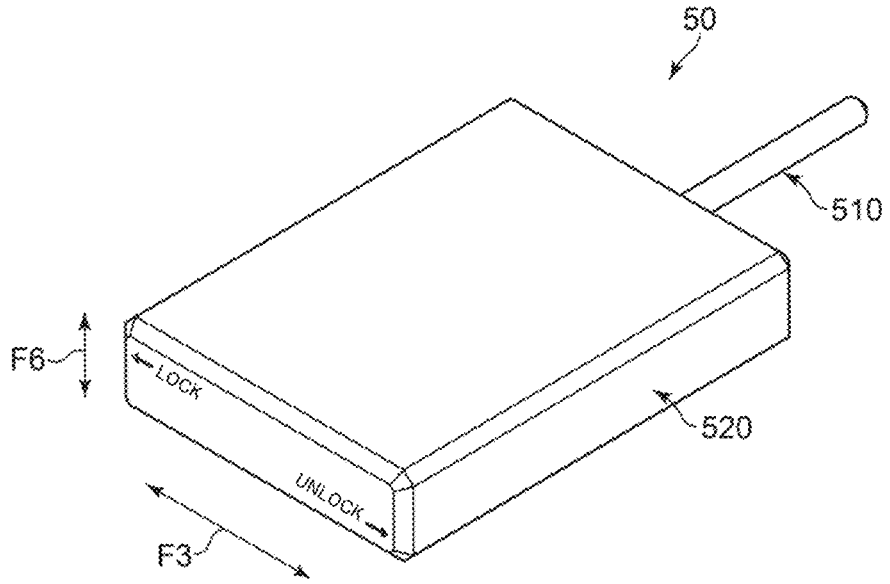
FIG. 11 is a perspective view of an operating jig to operate the retainer illustrated in FIG. 6.
Figure 12:
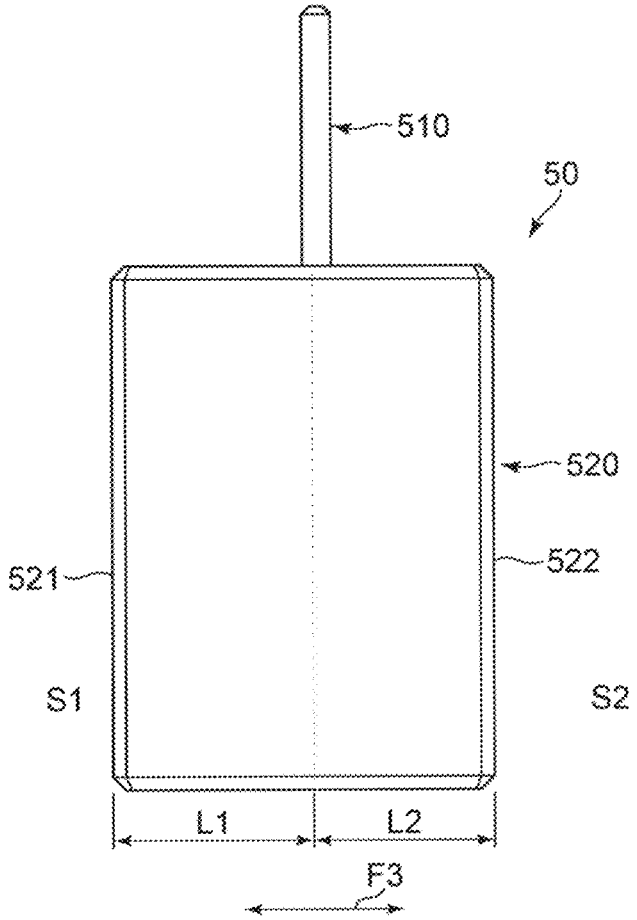
FIG. 12 is a plan view of the retainer illustrated in FIG. 11.

An explanation will be given of the operating jig 50 to operate the retainer 40. As illustrated in FIGS. 11, 12, a operating jig 50 includes an operating rod 510 and a grip 520.

The operating rod 510 is formed in a circular bar shape. The operating rod 510 protrudes perpendicularly from the one end face of the grip 520 along the lengthwise direction thereof. The operating rod 510 is formed so as to have a length corresponding to a distance between the tip of the projections 420 of the retainer 40 to the bottom surface of the operation hole as shown in FIG. 14. In addition, the operating rod 510 is disposed at the offset position toward the other side S2 from the center position of the grip 520 as viewed from the one face side of the grip 520 in a thickness direction F6 as illustrated in FIG. 12. In other words, the distance L1 is larger than the distance L2.

The grip 520 is formed in a thick plate shape as shown in FIG. 11. Letters that guide the operating directions are provided on opposite the end face of the grip 520 to the face from which the operating rod 510 protrudes.

An assembling method of the electrical connector 10 employing the above structure according to this embodiment of the present disclosure will be explained with reference to the figures.

First, the wires W are connected to the connection terminals 20 and the housing 30 without the retainer 40 is prepared.

Next, as illustrated in FIGS. 7, 8 (the retainer 40 is not yet attached to the housing 30), the connector terminals 20 are fitted in the terminal housing rooms 312 of the housing 30 from the rear end side thereof. The cylinder portion of the connector terminal 20 abuts the flexible piece 313 formed in the terminal housing room 312 when fitted therein.

The flexible piece 313 is warped on the inclined face of the tapered portion 22*a* of the cylinder portion 22. The flexible piece 313 elastically returns, and thus the lance 313*a* thereof is caught by the lance catch 22*c* when the cylinder portion 22 goes over the lance 313*a*. When the lance 313*a* is caught by the lance catch 22*c*, the fitting of the connector terminal 20 in the housing 30 completes.

Next, the retainer 40 is attached to the housing 30. When the retainer 40 is attached to the housing 30, the projections 420 of the retainer 40 are pinched by the chuck of an automation machine from both sides in the thickness direction F7 of the projection 420, allowing the projections 420 to be fitted in the slider groove 314. In addition, it is possible that a user inserts the operating rod 510 of the operating jig 50 in the operation hole 415 through the guide portion 421, and fits the retainer 40 in the slider groove 314 of the housing 30 by supporting the retainer 40 with the aid of the operating rod 510 while holding the grip 520.

When the retainer 40 is fitted in the slider groove 314, as illustrated in FIGS. 3, 5, the basal end portion 410 of the retainer 40 enters the basal-end-portion groove 314*a*, and the attachment portions 430 enter the respective attachment portion grooves 314*b* of the slider groove 314.

As illustrated in FIG. 4, the pawls 432 of the arms 431 of the attachment portion 430 which contact the respective attachment protrusions 314*e* of the attaching groove 314*b* causes the arms 431 to be warped, and the pawls 432 are pushed down. When the retainer 40 is further pushed in, the pawls 432 go over the respective attachment protrusion 314*e*, the arms 431 elastically return, and thus the pawls 432 are locked by the respective attachment protrusions 314*e*.

As illustrated in FIG. 2B, the fitting work of the retainer 40 in the slider groove 314 is guided to the unlocking position by the closing portion 314*g*. As illustrated in FIGS. 7, 8, the retainer 40 at the unlocking position has the offset positional relationship between the protrusions 413 formed on the basal end 410 and the convex portions 22*b* of the connector terminal 20 in the sliding direction F3. Hence, the connector terminals 20 are locked by the lance 313*a* of the housing 30 only, and the retainer 40 is not locking the connector terminals 20 in this condition.

In addition, as illustrated in FIG. 14, the convex portion 414*b* of the retainer 40 engaged with the recess 314*d*2 formed in the groove bottom wall 314*c* of the slider groove 314 at the other side S2.

The method of sliding the retainer 40 from the unlocking portion to the locking portion will be explained.

Figure 13:
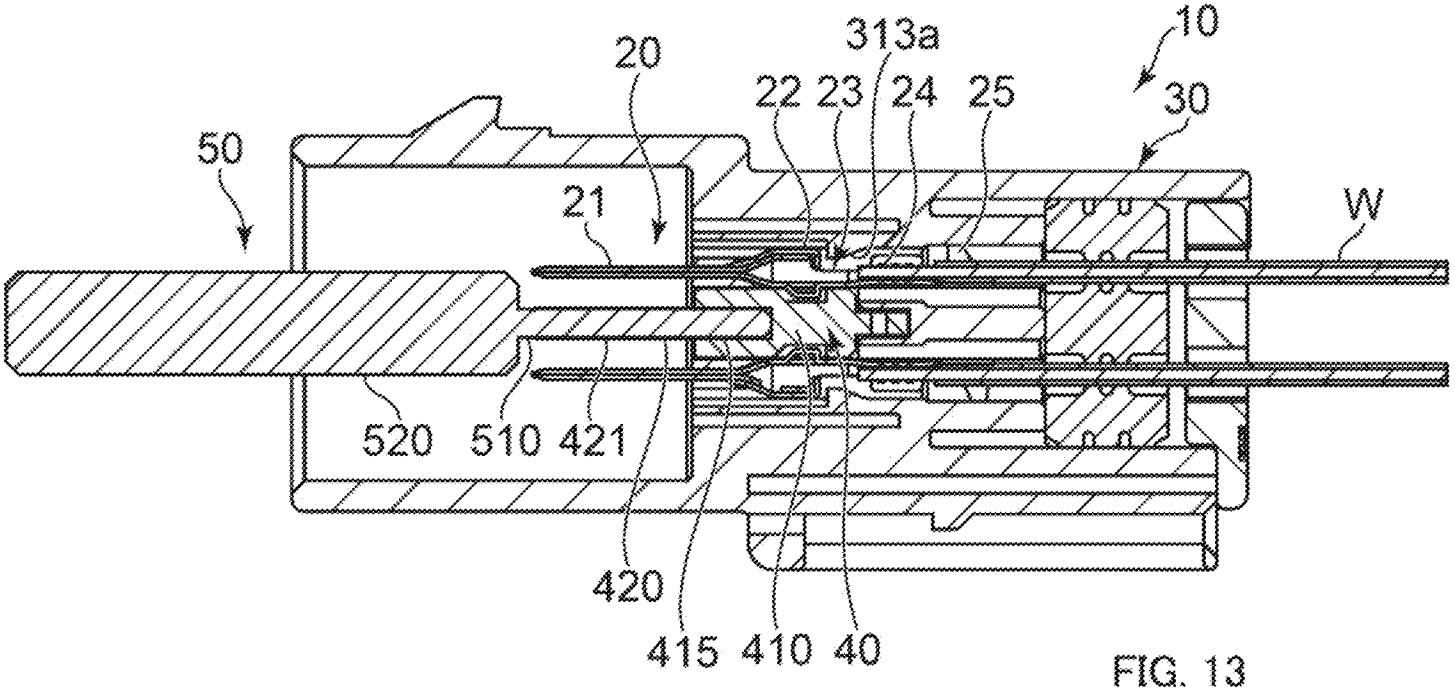
FIG. 13 is a vertical cross-sectional view orthogonal to a sliding direction in which the operating jig illustrated in FIG. 11 is inserted in the electrical connector illustrated in FIG. 1.

First as illustrated in FIGS. 13 and 14, the user inserts the operating rod 510 of the operating jig 50 into the operation hole 415 through the guide portion 421 in an appropriate posture.

As shown in FIG. 12, the operating rod 510 is offset from the center position of the grip 520. Hence, the appropriate posture of the operating jig 50 is a posture in which the operating rod 510 is located at the offset position from the center position of the grip 520 toward the other side S2. Even if the user tries to inset the operating rod 510 to the operation hole 415 in an inappropriate posture, the user can find it easily as described later.

With the operating jig 50 being inserted in the retainer 40 in the appropriate posture as illustrated in FIG. 14, the user slides the operating jig 50 from the other side S2 to the one side S1. This operation moves the retainer 40 from the unlocking position to the locking position as shown in an arrow F8.

As the retainer 40 slides in the sliding direction F8 illustrated in FIG. 14, the basal end 410 moves in the basal-end-portion groove 314*a*, and the attachment portions 430 move in the respective attachment portion grooves 314*b* of the slider groove 314. The cross-linking portion 414*a* warps engagement convexity 414 formed on the basal end 410 has the convex portion 414*b* moved, and thus the cross-linking portion 414*a* is warped, and is disengaged from the recess 314*d*2. The convex portion 414*b* slides over the groove bottom wall 314*c*, and moves up to a position of the recess 314*d*1. In this case, as illustrated in FIG. 15, the cross-linking portion 414*a* elastically returns, and is engaged with the recess 314*d*1. At this time, the side face 521 of the grip 520 abuts the internal wall 321*c* of the engagement hole 321 of the housing 30.

As illustrated in FIGS. 9, 10, the protrusions 413 of the retainer 40 are located at the forward side in the releasing direction F9 of the convex portions 22*b* of the respective connector terminals 20. Since the protrusion 413 is located at the forward side in the releasing direction F9 of the convex portion 22*b*, the connector terminal 20 is locked. By the locking accomplished by the lance 313*a* of the housing 30 and the locking by the protrusion 413 of the retainer 40, the connector terminal 20 is doubly locked.

Next, an explanation will be given of a case in which the user operates the operating jig 50 to slide the retainer 40 from the locking position to the unlocking position.

When the user slides the retainer 40 to the unlocking position, and cancels the locking of the connector terminal 20 by the protrusion 413 of the retainer 40, the user slides the retainer 40 toward the other side S2 in the sliding direction F3 (sliding direction F10 illustrated in FIG. 15) using the operating jig 50.

The retainer 40 is moved toward the other side S2 along the slider groove 314. The convex portion 414*b* of the engagement convexity 414 formed on the basal end 410 is released from the recess 314*d*1, slides over the groove bottom wall 314*c*, and is engaged with the recess 314*d*2 as illustrated in FIG. 14. At this time, the side face 522 of the grip 520 of the operating jig 50 at the other side S2 in the sliding direction F3 abuts an internal wall 321*d* of the engagement hole 321 of the housing 30.

As illustrated in FIGS. 7, 8, the protrusions 413 of the retainer 40 return to the positions when the retainer 40 was fitted. Namely, the protrusions 413 are released from at the forward positions in the releasing direction F9 of the convex portions 22*b* of the connector terminals 20, and thus the locking by the protrusion 413 of the retainer 40 is canceled.

As explained above, the retainer 40 is provided with the projections 420 having the guide portion 421, that project toward the opening 321*b* of the engagement hole 321. Hence, the operator can easily insert the operation rod 510 into the operation hole 415 of the basal end 410 through the guide portion 421 of the projections 420.

According to this embodiment, the retainer 40 is fitted through the engagement hole 321 of the housing 30. This enables a sure operation to the retainer 40 using the operating jig 50 without any damages to the tab portion 21 of the connector terminal 20 and the internal wall of the engagement hole 321 of the housing 30 even if the downsizing of the electrical connector 10 advances and the dimension of the opening 321*b* of the engagement hole 321 becomes narrow.

In addition, when the retainer 40 is slid from the unlocking position to the locking position, the user slides the grip 520 until the grip 520 abuts the internal wall 321*c* of the engagement hole 321. Conversely, when the retainer 40 is slid from the locking position to the unlocking position, the user slides the grip 520 until the grip abuts the internal wall 321*d* of the engagement hole 321. Hence, the user can operate the operating jig 50 without any wonder, and can surely dispose the retainer 40 at the target position.

At this time, vibrations caused when the convex portion 414*b* is engaged with the recess 314*d*1 or the recess 314*d*2 are transmitted to the user via the operating jig 50. In addition, sounds produced when the convex portion 414*b* is engaged with the recess 314*d*1 or the recess 314*d*2 are transmitted to the user. Therefore, the user holding the operating jig 50 can recognize that the retainer 40 has been slid to the target position and the operation has completed based on the vibrations from the grip 520 and the engagement sounds.

Still further, as illustrated in FIG. 6, the cut-out section 421*b* is formed in the guide portion 421 along the insertion direction F4 of the operating jig 50 from the insertion opening 421*a* to the operation hole 415. Hence, in order to ensure the rigidity of the operating rod 510, even if the operating rod 510 is designed to have a certain thickness, by allowing the operating rod 510 to project from the cut-out section 421*b*, the projections 420 can have a thickness made thin.

As illustrated in FIG. 2B, the contour dimension of the projection 420 as viewed from the opening 321*b* is formed so as to be smaller than that of the basal end 410. Accordingly, even in the case of the electrical connector that has a narrow engagement hole 321, the retainer 40 can have the projections 420.

Next, an explanation will be given of a case in which the operating jig 50 is operated in an inappropriate posture. The inappropriate posture of the operating jig 50 is a reversed posture that has both ends of the grip 520 in the sliding direction F3 of the retainer 40 reversed from those of the appropriate posture.

First, an explanation will be given of a case in which the retainer 40 is located at the unlocking position.

Figure 16:
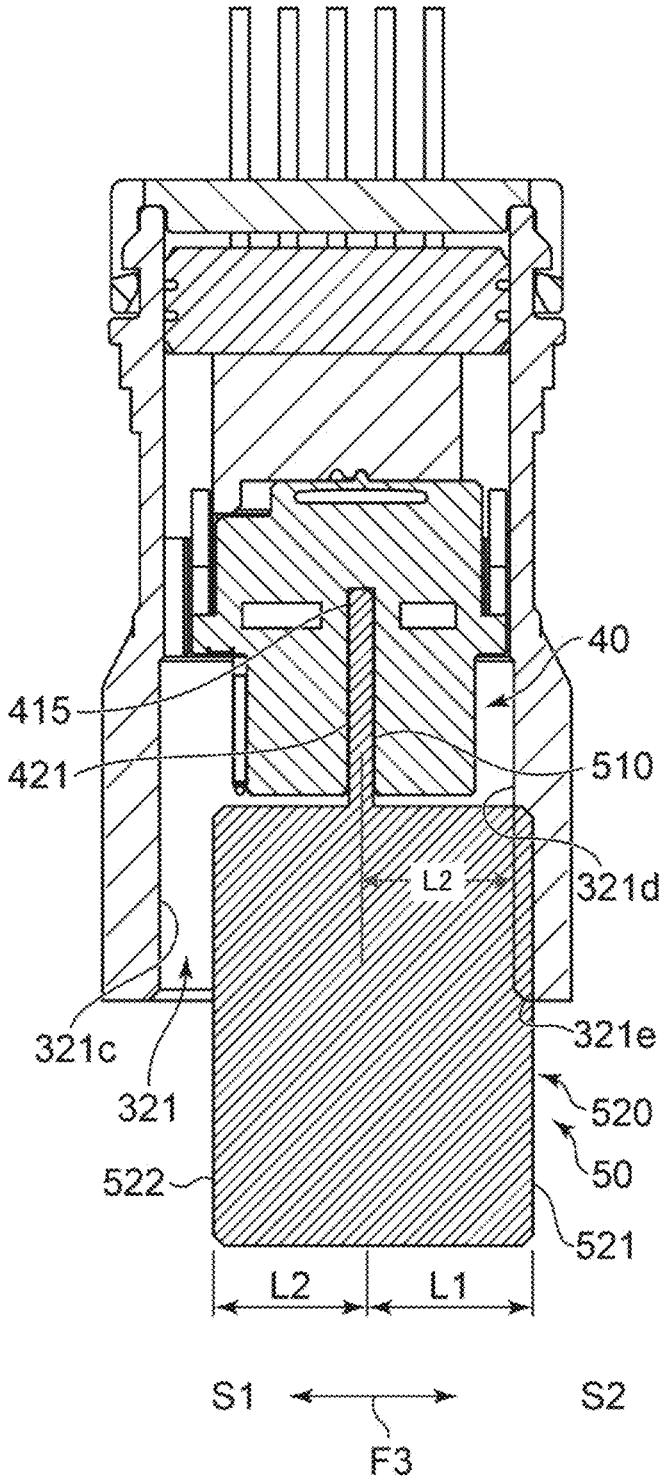
FIG. 16 is a horizontal cross-sectional view when the retainer of the electrical connector illustrated in FIG. 13 is at the unlocking position, and the operating jig is inserted in the retainer in a reversed posture.

As illustrated in FIG. 16, when the retainer 40 is located at the unlocking position, the retainer 40 is located at an offset position toward the other side S2. In addition, in the inappropriate posture that has the reversed operating jig 50 illustrated in FIG. 16, with reference to the operating rod 510, the operating jig 50 has the longer distance L1 up to the side face 521 of the grip 520 at the other side S2 than the distance L2 up to the side face 522 at the one side S1. Hence, if the user attempts to insert the operating rod 510 into the guide portion 421 with the operating jig 50 being in an inappropriate posture, the grip 520 interfere with an aperture edge 321*e* of the engagement opening 321. Hence, the user can recognize that the user is attempting to operate the retainer 40 with the operating jig 50 being in an inappropriate posture. FIG. 16 illustrates a condition in which the grip 520 overlaps and interferes with the internal wall 321*d* of the engagement opening 321.

Next, an explanation will be given of a case in which the retainer 40 is located at the locking position.

Figure 17:
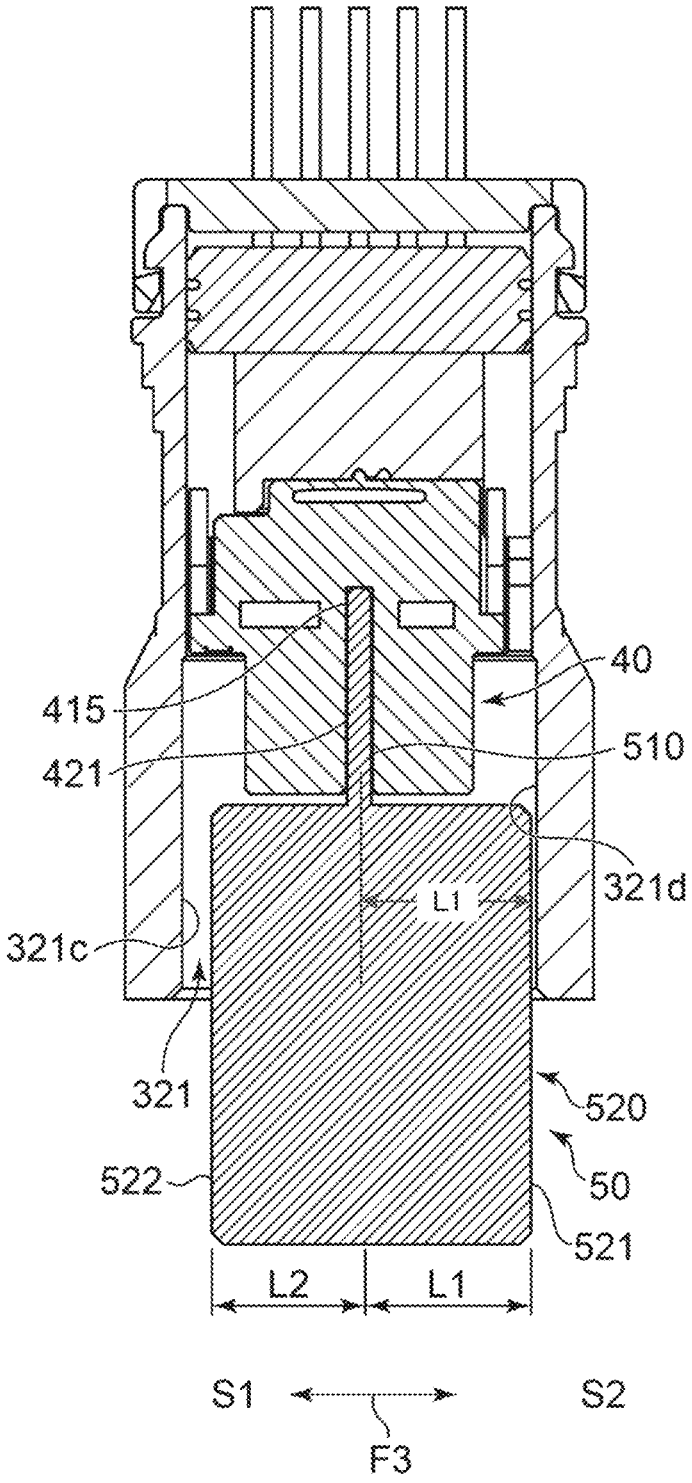
FIG. 17 is a horizontal cross-sectional view when the retainer of the electrical connector illustrated in FIG. 13 is at the locking position, and the operating jig is inserted in the retainer in the reversed posture.

As illustrated in FIG. 17, when the retainer 40 is located at the locking position, the retainer 40 is displaced toward the one side S1 of the housing 30. The user can insert the operating rod 510 into the operation hole 450 through the guide portion 421 with the operating jig 50 being in an inappropriate posture. However, the side face 521 of the grip 520 abuts the internal wall 321*d* of the engagement hole 321, and thus the sliding of the grip 520 is restricted. Hence, the user can recognize that the user is attempting to operate the retainer 40 with the operating jig 50 being in an inappropriate posture.

As illustrated in FIG. 18, foreign materials may enter the engagement hole 321 of the housing 30, and the engagement counterpart electrical connector may enter deeply in the engagement hole 321 in an inclined condition relative to the engagement direction F1. However, the projections 420 are formed so as to have tips be located at the same position as that of the tip of the connector terminal 20 in the projecting direction F5 toward the engagement hole 321. Hence, the projections 420 of the retainer 40 prevent foreign materials from entering, and the inclined counterpart housing from being inserted before contacting the connector terminal 20. Accordingly, a damage and a deformation of the tab portion 21 of the connector terminal 20 are suppressed.

Note that the projections 420 illustrated in FIG. 18 may be formed so as to project toward the engagement hole 321 side beyond the tab portion 21. Foreign materials and the engagement counterpart electrical connector first contact the projections 420 before the tab portion 21, a deformation of the tab portion 21 and a damage to the housing of the engagement counterpart electrical connector are suppressed.

In addition, the housing 30 and the retainer 40 have the recesses 314*d*1, 314*d*2 of the housing 30 and the convex portion 414*b* of the engagement convexity 414 of the retainer engaged with each other. Conversely, the housing 30 may have a convex portion, while the retainer may have a recess.

Second Embodiment

An electrical connector according to a second embodiment of the present disclosure will be explained with reference to the figures. Note that in FIGS. 19-22, the same component illustrated in FIGS. 6, 11, 12 will be denoted by the same reference numeral.

The electrical connector according to the second embodiment has the retainer guide portion which has both ends in the sliding direction or the orthogonal direction thereto formed asymmetrically.

Figure 19:
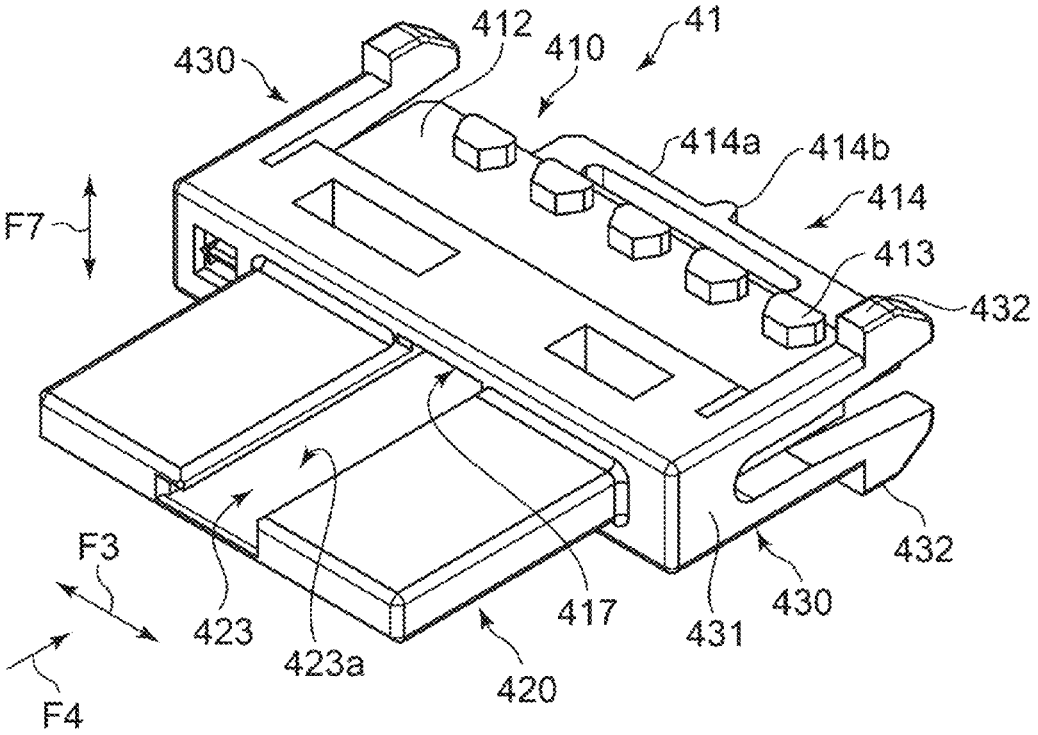
FIG. 19 is a perspective view illustrating a retainer of an electrical connector according to a second embodiment of the present disclosure.
Figure 20:
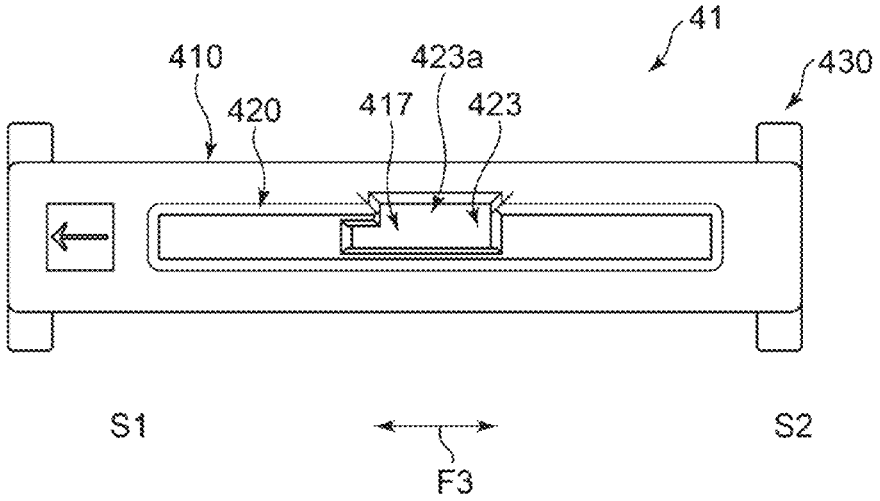
FIG. 20 is a front view of the retainer illustrated in FIG. 19.
Figure 21:
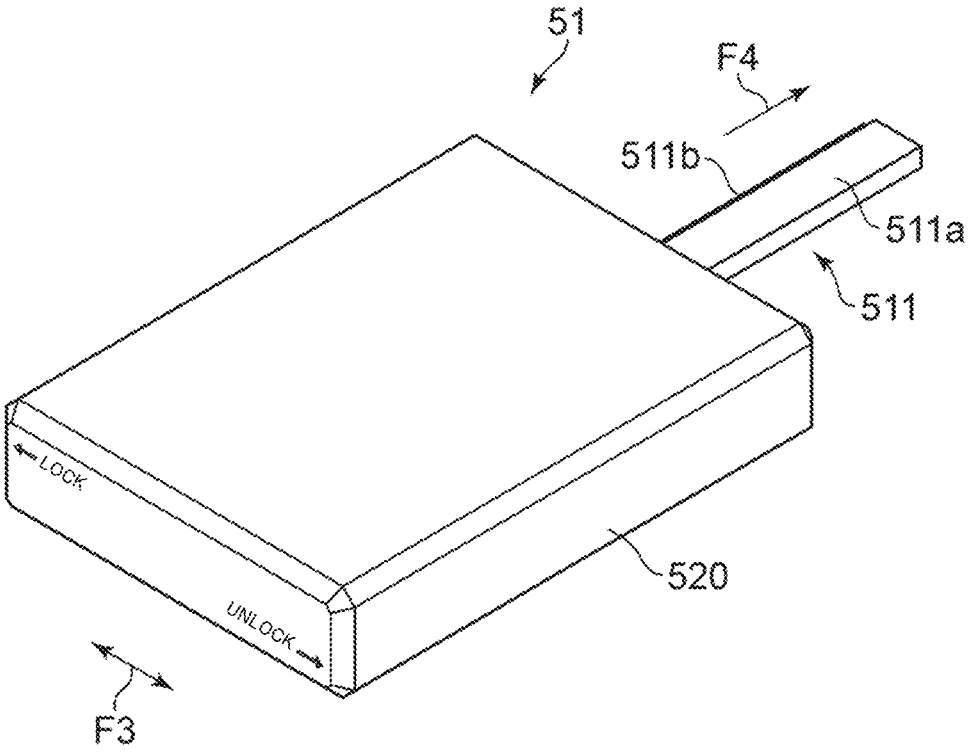
FIG. 21 is a perspective view of an operating jig to operate the retainer illustrated in FIG. 19.
Figure 22:
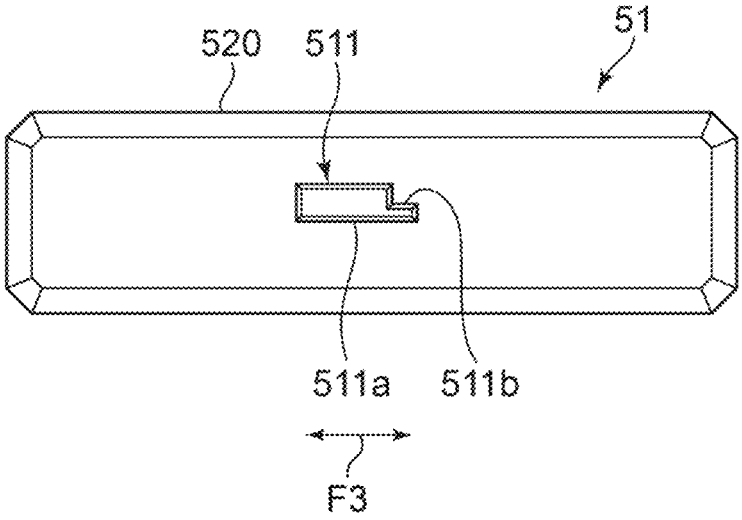
FIG. 22 is a diagram of the operating jig illustrated in FIG. 21 as viewed from an operating rod side.
Figure 23:
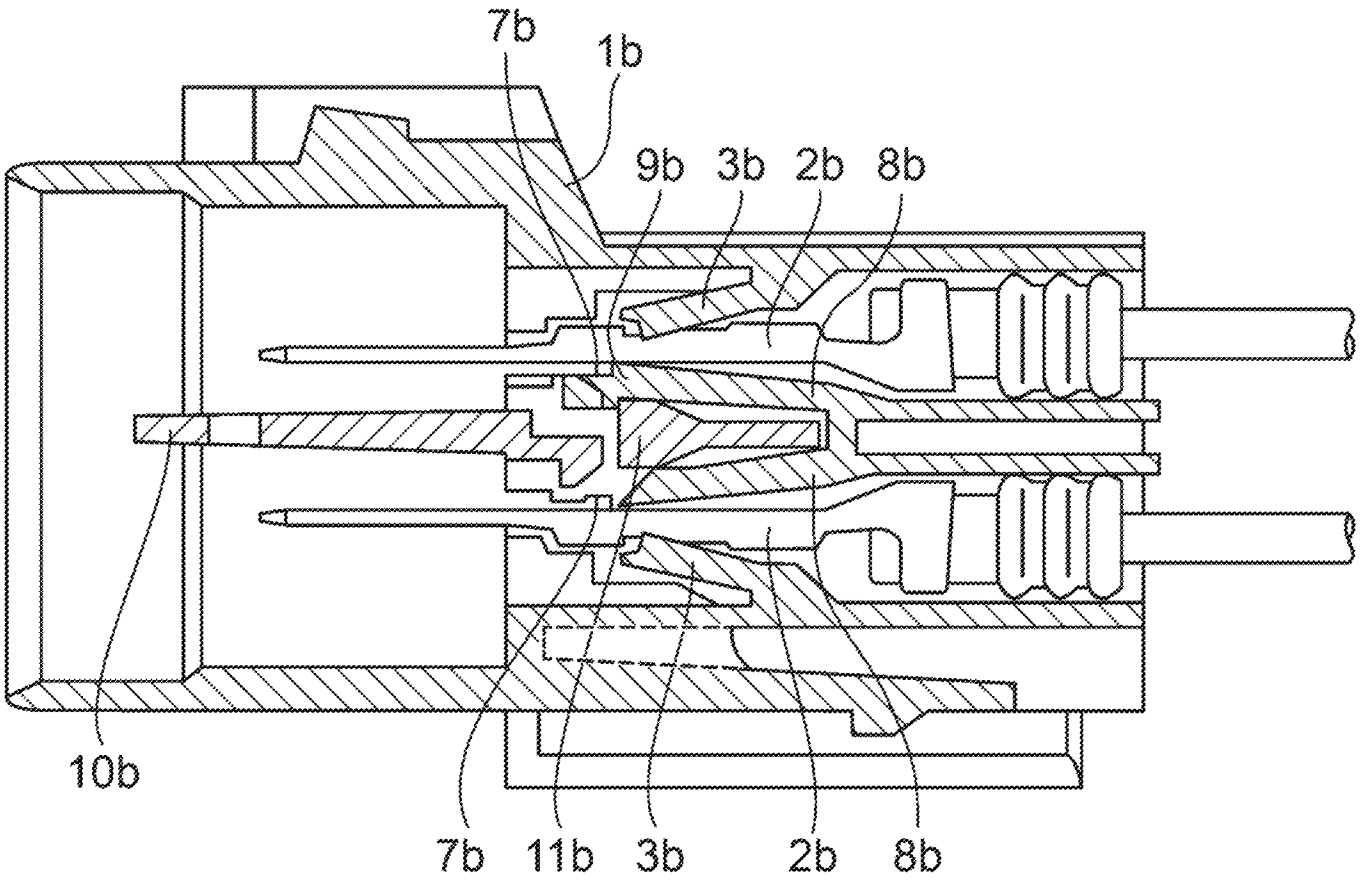
FIG. 23 (PRIOR ART)
FIG. 23 is a vertical cross-sectional view of the electrical connector disclosed in Patent Literature 1.
Figure 24:
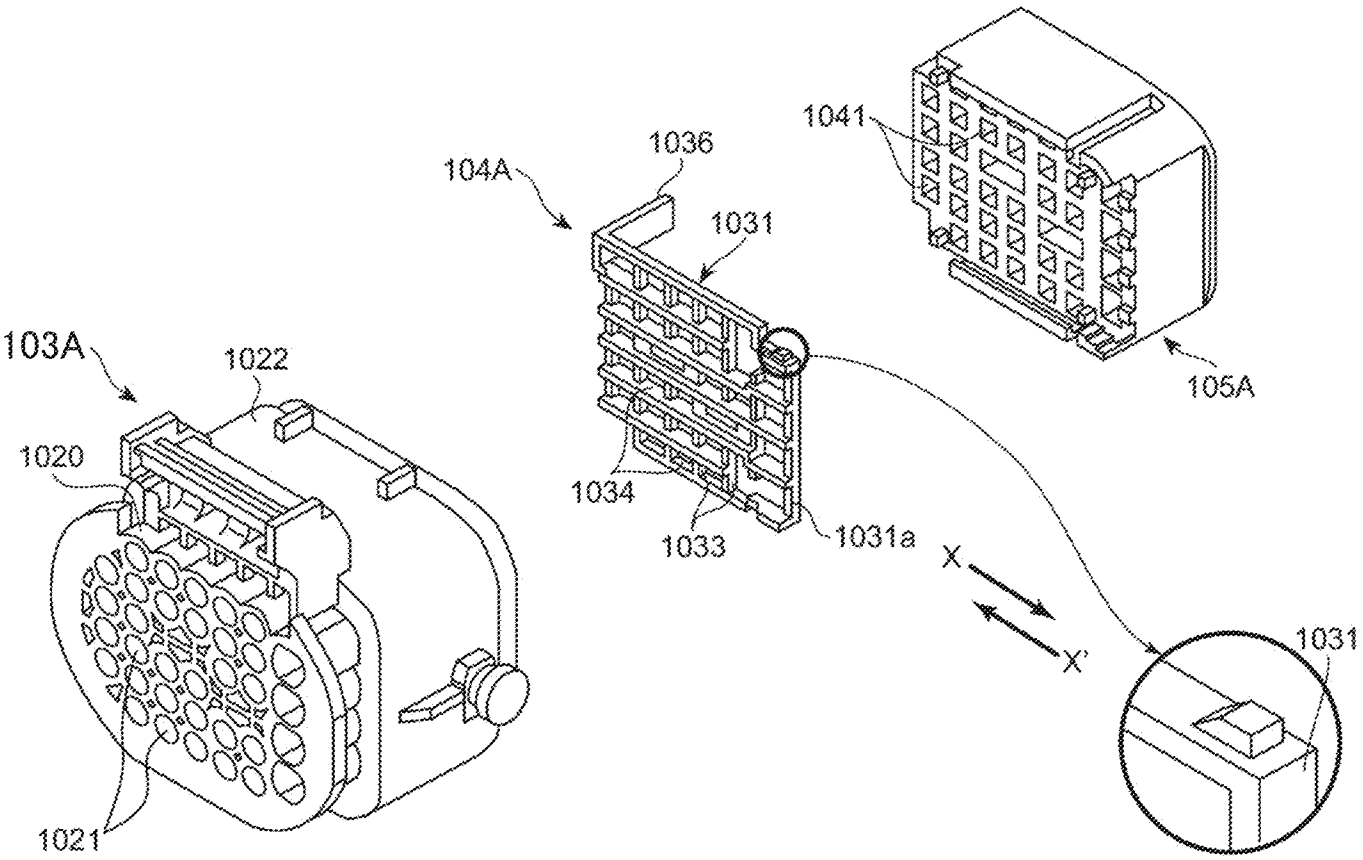
FIG. 24 (PRIOR ART)
FIG. 24 is a perspective view illustrating the electrical connector disclosed in Patent Literature 2.
Figure 25:
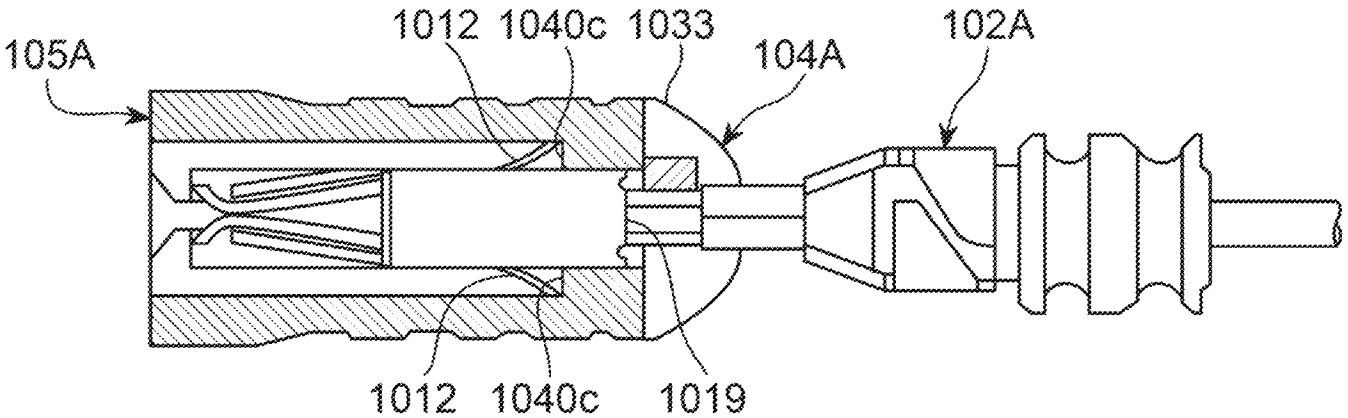
FIG. 25 (PRIOR ART)
FIG. 25 is an enlarged view of the electrical connector shown in FIG. 24.
Figure 26:
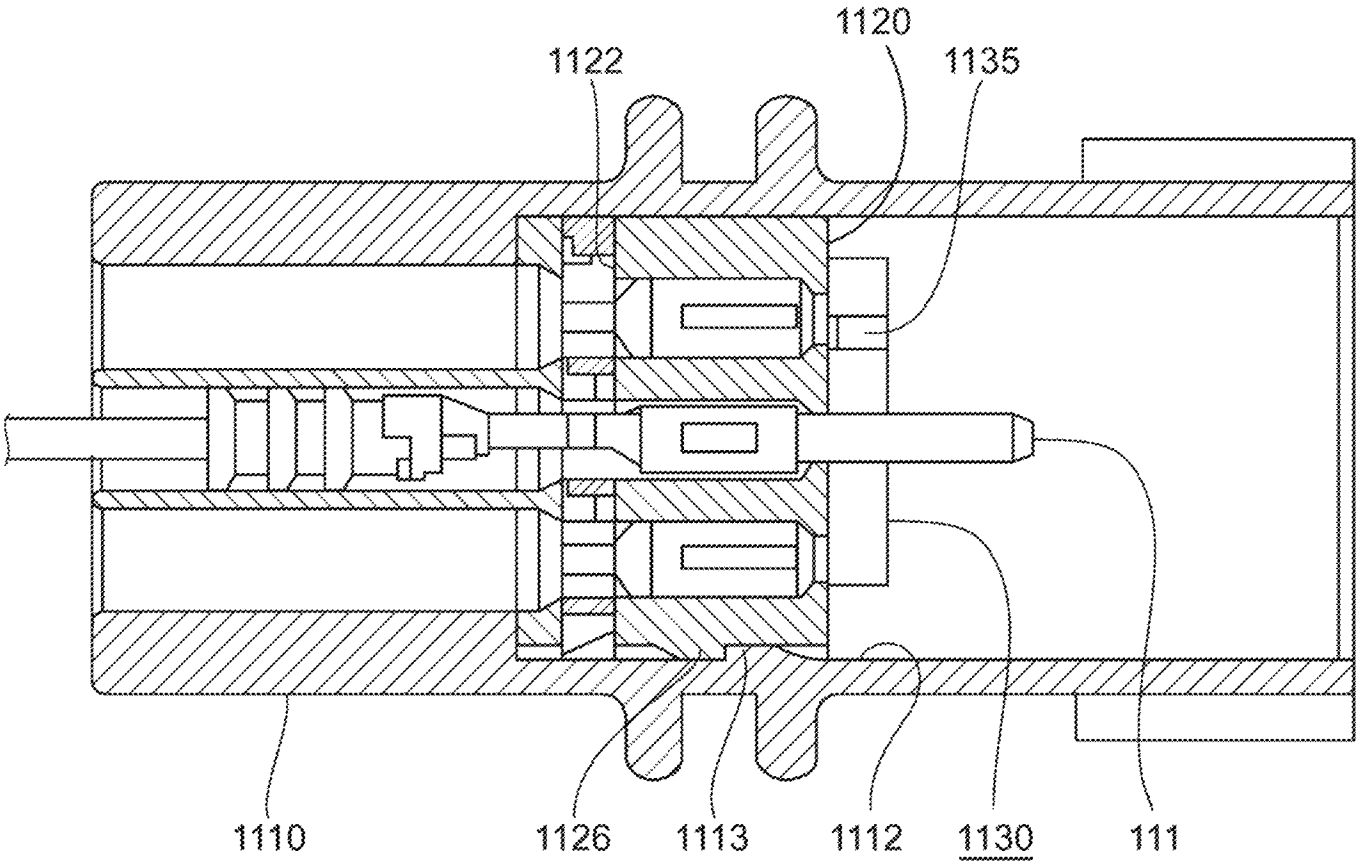
FIG. 26 (PRIOR ART)
FIG. 26 is a horizontal cross-sectional view of the electrical connector disclosed in Patent Literature 3.

A retainer 41 illustrated in FIGS. 19, 20 has an operation hole 417 at the basal end 410 and a guide portion 433 at the projections 420 formed along the insertion direction F4 of an operating rod 511 of an operating jig 51 illustrated in FIGS. 21, 22.

As viewed in the insertion direction F4, the operation hole 417 is formed in such a way that a portion of the end of the rectangular hole at the one side S1 elongates the width of the rectangular hole. The guide portion 423 is formed continuous with the operation hole 417. The guide portion 423 is formed with a cut-out section 423*a* which has a closed bottom wall and a partially closed top wall in the thickness direction F7. Like this, the operation hole 417 and the guide portion 423, at both ends in the sliding direction F3, are formed asymmetrically.

The operating rod 511 of the operating jig 51 is formed so as to match the shape of the operation hole 417 and that of the guide portion 423. Specifically, the operating rod 511 includes a bar main body 511*a* in a square bar shape, and a keyed portion 511*b* formed at a part of the end of the bar main body 511*a* at the one side S1 so as to increase the width of the bar main body 511*a*.

When the retainer 41 is operated, if the operating jig 51 is in an appropriate posture, the user can insert the operating rod 511 in the operation hole 417 via the guide portion 423. When, however, the user attempts to insert the operating rod 511 in the guide portion 423 with the operating jig 51 being in an inappropriate posture, since the guide portion 423 is formed asymmetrically at both ends in the sliding direction F3, the keyed portion 511*b* abuts the front face of the projection 420, and thus the operating jig 51 cannot be inserted in the guide portion 423. Hence, when inserting the operating jig 51 in the projections 420, the user can recognize whether the operating jig 51 is in an appropriate posture or in an inappropriate posture.

Note that in the second embodiment, although the both ends of the guide portion 423 in the sliding direction F3 are formed asymmetrically, the guide portion may have the both ends in the orthogonal direction (thickness direction F7) to the sliding direction F3 in FIG. 19 formed asymmetrically. The guide portion formed in such a shape can restrict the insertion of the operating jig in the operation hole even if the operating rod is inserted in the guide portion with the operating jig being in an inappropriate posture.

The disclosure of this specification is no limited to the embodiments.

For example, in the embodiments, the connector terminals are the mail terminals. The connector terminals may be female terminals.

In the embodiments, the slide groove 314 has an H-shape in plain view. The shape of the slide groove is arbitral, if the retainer can slide in the groove.

The shapes and structures of the base end 410 of the retainer 40 are arbitral, if the retainer 40 can lock the connection terminals 20.

The shapes and structures of the projections 420 of the retainer 40 are arbitral, if the projections can be used to insert the retainer 40 into the slide groove 314 and guide the operation jig 50 to the operation hole 415. For example, the projection may be formed in a rectangular cylinder or a circular cylinder.

The cross sections of the guide portion 421 and the operation hole 415 may not be same with each other. In the embodiments, the insertion opening 421*a* is formed so as to spread. The guide portion 421 may spread the open area toward the insertion opening 421 gradually or in step wise.

The cut-out portion 421*b* may not be formed in the guide portion 421.

The way for forming the guide portion asynchronously is arbitral. For example, a projection may be formed in the guide portion and a groove accommodating the projection may be formed in the operating jig.

The housing 30 and the retainer 40 may not have recesses 314*d*1 and 314*d*2, and the convex portion 414*b*.

In the embodiments, the projections 420 haves a contour dimension as viewed from the opening 321*b* of the engagement hole 321 which is smaller than that of the basal end 410 in both of the sliding direction F3 and the orthogonal direction thereto. The projections 420 may have a contour dimension as viewed from the opening of the engagement hole 321*b* which is smaller than that of the basal end 410 in one of the sliding direction F3 and the orthogonal direction thereto.

In the embodiments, the operating jig 50 comprises the operating rod 510,511 and the grip 520, 521. The operating jig 50, 51 may have a structure different from the described one. For example, am operating jig comprises a bar may be used.

Even in the state that the operating jig 50 is inserted in the retainer 40 in an appropriate posture and the retainer 40 is in the locking or unlocking position, the operating jig 50 may not abut the internal wall 321*c* of the engagement hole 321 of the housing 30. It is also possible that even when the state that the operating jig 50 is inserted in the retainer 40 in an inappropriate posture, the operating jig 50 may not interfere nor abut the internal wall 321*c* of the engagement hole 321 of the housing 30.

Further, in the first embodiment, with the operating jig 50 being in an inappropriate posture, when the retainer is in the unlocking position, the operating jig 50 interferes with an aperture edge of the engagement hole 321, and the insertion of the operating jig 50 in the guide portion 421 is prevented, and when the operating jig 50 is inserted in the guide portion 421 and the retainer 40 is in the locking position, the operating jig 50 abuts the internal wall of the engagement hole 321, and a sliding of the retainer 40 and the operating jig 50 are restricted. On the other hands, with the operating jig 50 being in an inappropriate posture, when the retainer 40 is in the locking position, the operating jig 50 may interfere with the aperture edge of the engagement hole 321, and when the operating jig 50 is inserted in the guide portion 421 and the retainer 40 is in the unlocking position, the operating jig 50 abuts the internal wall of the engagement hole 321, and a sliding of the operating jig 50 may be restricted.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An electrical connector comprising:

a connector terminal;

a housing comprising a terminal housing room in which the connector terminal is to be fitted, an engagement hole in which an engagement counterpart electrical connector is to be fitted, and a slider groove that is formed in a backmost wall of the engagement hole so as to extend in a direction intersecting with a fitting and releasing direction of the connector terminal; and a retainer which comprises a protrusion that locks the connector terminal fitted in the terminal housing room, and which changes a position between an unlock position where the protrusion unlocks the connector terminal, and a locking position which is reachable by sliding from the unlock position along the slider groove, and where the protrusion locks the connector terminal, wherein:

the retainer further comprises a basal end portion to be housed in the slider groove, and a projection projecting from the basal end toward an opening of the engagement hole;

the basal end is formed with an operation hole in which a operating jig is inserted, the operating jig changing the position of the retainer between the unlocking position and the locking position; and the projection is formed with a guide portion that guides an insertion of the operating jig into the operation hole.

2. The electrical connector according to claim 1, wherein the guide portion is formed with, from an insertion opening in which the operating jig is inserted to the operation hole of the basal end, a cut-out section along an insertion direction of the operating jig.

3. The electrical connector according to claim 1, wherein the guide portion has both ends in a sliding direction of the basal end or an orthogonal direction to the sliding direction formed asymmetrically to restrict the insertion of the operating jig in the operation hole in an inappropriate posture.

4. The electrical connector according to claim 1, wherein the basal end comprises a recess, or a convex portion engaged with a convex portion or a recess of the housing when the retainer is located at the unlocking position and the locking position, respectively.

5. The electrical connector according to claim 1, wherein the projection has a contour dimension as viewed from an opening of the engagement hole smaller than the basal end in either one of or both of a sliding direction and an orthogonal direction to the sliding direction.

6. The electrical connector according to claim 1, wherein a position of a tip of the projection is consistent with a position of a tip of the connector terminal in a projecting direction toward the engagement hole or projects from the position of the tip of the connector terminal.

7. The electrical connector according to claim 1, wherein when with the operating jig being in an appropriate posture, the operating jig is inserted in the operation hole of the retainer, and the retainer is in the unlocking position and/or the locking position, the operating jig abuts an internal wall of the engagement hole of the housing.

8. The electrical connector according to claim 1, wherein:

with the operating jig being in an inappropriate posture, when the retainer is in the unlocking position or the locking position, the operating jig interferes with an aperture edge of the engagement hole, and the insertion of the operating jig in the guide portion is prevented; and with the operating jig being in the inappropriate posture, when the operating jig is inserted in the guide portion and the retainer is in the locking position or the unlocking position, the operating jig abuts the internal wall of the engagement hole, and a sliding of the operating jig is restricted.

9. The electrical connector according to claim 1, wherein:

with the operating jig being in an inappropriate posture, the operating jig interferes with the guide portion of the retainer and can be not inserted into the guide portion.

* * * * *